US009708818B2

(12) United States Patent
Kim

(10) Patent No.: US 9,708,818 B2
(45) Date of Patent: Jul. 18, 2017

(54) DOUBLE FLOOR PLATE MATERIAL STRUCTURE AND METHOD FOR FORMING THE SAME

(71) Applicant: Oh Soo Kim, Anyang-si (KR)

(72) Inventor: Oh Soo Kim, Anyang-si (KR)

( * ) Notice: Subject to any disclaimer, the term of this patent is extended or adjusted under 35 U.S.C. 154(b) by 98 days.

(21) Appl. No.: 14/721,321

(22) Filed: May 26, 2015

(65) Prior Publication Data

US 2015/0337544 A1 Nov. 26, 2015

(30) Foreign Application Priority Data

May 26, 2014 (KR) ..... 10-2014-0062864

(51) Int. Cl.
*E04F 15/024* (2006.01)

(52) U.S. Cl.
CPC .. *E04F 15/02429* (2013.01); *E04F 15/02417* (2013.01); *Y10T 29/49828* (2015.01)

(58) Field of Classification Search
CPC ..... E04F 15/02429; E04F 15/02417; Y10T 29/49828
See application file for complete search history.

(56) References Cited

U.S. PATENT DOCUMENTS 7,490,439 B2 * 2/2009 Teramura ..... E04F 15/02452 52/126.6

FOREIGN PATENT DOCUMENTS

| | | | |
|---|---|---|---|
| JP | 10-115077 | A | 5/1998 |
| JP | 3119254 | U | 2/2006 |
| KR | 2002-99579 | Y1 | 12/2002 |
| KR | 10-2012-0027921 | A | 3/2012 |

* cited by examiner

*Primary Examiner* — John C Hong
(74) *Attorney, Agent, or Firm* — KORUS Patent, LLC; Seong Il Jeong

(57) ABSTRACT

Disclosed are a raised access floor panel material structure disposed on a floor of a structure, wherein a floor panel material of floor material capable of easily accommodating wires for power, computer and communication or devices such as air conditioning facilities etc. at its lower part is formed in an assembled manner by a floor consisting of combined unit panels and is conveniently laid on the a floor surface to form a neat floor panel and a method for forming the raised floor panel material structure.

3 Claims, 9 Drawing Sheets

(a)

(b)

Prior Art (a)

DOUBLE FLOOR PLATE MATERIAL STRUCTURE AND METHOD FOR FORMING THE SAME

CROSS REFERENCE TO RELATED APPLICATIONS

This application claims priority based on Korean Patent Application No. 10-2014-0062864 filed May 26, 2014, the contents of all of which are incorporated herein by reference in their entirety.

TECHNICAL FIELD

The present invention relates to a raised access floor panel material structure disposed on a floor of a structure, wherein a floor panel material of floor material capable of easily accommodating wires for power, computer and communication or devices such as air conditioning facilities etc. at its lower part is formed in an assembled manner by a floor consisting of combined unit panels and is conveniently laid on the a floor surface to form a neat floor panel. The present invention also relates to a method for forming the raised access floor panel material structure.

In particular, the present invention relates to a raised access floor panel material structure and a method for forming it, characterized in that, in forming lateral parts at which the floor panel materials can contact with each other, an angle of about 4 to 5° is imparted to the lateral part when forming a tapered lateral part with a tapered angle by vertical bending, wherein the tapered lateral parts are coupled in linear contact with each other, thereby avoiding occurrence of noise due to friction or shock, and for enhancing such an effect, a molded block (TRIM) closely contacting with the tapered lateral part is formed by molding, wherein a perfect molding is achieved by forming a space defined by a mold core inside the mold and implementing an insert molding.

The present invention does not relate to a conventional structure wherein when welding upper and lower plates, wings are formed and thereafter trim or edge tapes are manually inserted or glued, but to a structure and forming method wherein the upper iron plate is inclinedly bent toward the lower iron plate by an angle of 4 to 5°, thereby reducing the friction-induced noise and increasing ability of the lateral part to support a vertical load and holes for passage of injection molding material are formed in the bent part of the upper plate and the injection molding material passes through the holes of the upper iron plate during the injection molding and then is cured and thus permanently the trim is not separated.

BACKGROUND ART

Generally, in the case of a floor panel, plastering work is done through cement molding and a floor material or linoleum is laid on it and used. Furthermore, nowadays, in an office, power lines have to be complicatedly connected and various IT devices have to be laid, and therefore, separate communication lines also have to be complicatedly connected. Thus, a separate floor panel material such as the present invention is laid and a space part in a lower part of the floor panel material is used as a line-arranging space.

That is to say, it is a way of forming a floor surface inside a building by laying a floor panel material where an upper plate (2) and a lower plate (3) are coupled by spot welding and an external tile (1) is glued to an upper end of the upper plate (2) and a lower end of the lower plate (3) is provided with a plurality of separate legs which are adjustable in height. Such a way allows easy arrangement of multiple power lines and communication lines, but has several problems. In the case of the conventional floor panel material, when coupling the floor panel materials with each other with edges of end portions of the floor panel material being horizontally oriented, a separate finishing pad is added so that the floor panel materials do not collide with each other, as illustrated in FIG. 1. The purpose of adding the finishing pad made of synthetic resin is to prevent occurrence of noise due to the friction and enhance a durability of the floor panel material.

However, in such an example, a phenomenon occurs that the end portion is deflected or one side of the floor panel material is raised, as illustrated in FIG. 2. If a high load is abruptly applied due to a weight of an object or person resting on the floor panel material, the end portion of the floor panel material is deflected or a part stepped on is depressed and thus another side is raised, whereby misalignment of the floor surface may occur. Furthermore, the intention to prevent the noise is not reached and thus much noise occurs.

SUMMARY OF THE INVENTION

Technical Problems

The present invention aims at providing a raised access floor panel material structure wherein a floor panel material of floor material capable of easily accommodating wires for power, computer and communication or devices such as air conditioning facilities etc. at its lower part is formed in an assembled manner and is conveniently laid on the a floor surface to form a neat floor panel, and aims at providing a method for forming the raised access floor panel material structure.

In particular, the present invention aims at providing a raised access floor panel material structure and a method for forming it, characterized in that, in forming lateral parts at which the floor panel materials can contact with each other, an angle of about 4 to 5° is imparted to the lateral part when forming a tapered lateral part with a tapered angle, wherein the tapered lateral parts are coupled in linear contact with each other, thereby avoiding occurrence of noise due to friction or shock, and for enhancing such an effect, a molded block (TRIM) closely contacting with the tapered lateral part is formed by molding, wherein a perfect molding is achieved by forming a space defined by a mold core inside the mold and implementing an insert molding.

The present invention does not relate to a conventional structure wherein when welding upper and lower plates, wings are formed and thereafter trim or edge tapes are manually inserted or glued, but to a structure and forming method wherein the upper iron plate is inclinedly bent toward the lower iron plate by an angle of 4 to 5°, thereby reducing the friction-induced noise and increasing ability of the lateral part to support a vertical load and holes for passage of injection molding material are formed in the bent part of the upper plate and the injection molding material passes through the holes of the upper iron plate during the injection molding and then is cured and thus permanently the trim is not separated.

Solution to the Problem

A raised access floor panel material structure according to the present invention includes a lower plate (30) which is formed by punching a plate and pressing the plate to obtain a certain width in an up-and-down direction, in such a way that a central area of the lower plate has a space part (31) and punching shaped parts (33) and an edge area has a planar rim part (32) with a constant level; an upper plate (20) which is stacked on an upper end of the lower plate (30) to thereby cover the lower plate, a central area of which forms a flat plate part (21), and an edge area of which has a tapered lateral part (22) bent downwards so as to accommodate the width of the lower plate (30); an external tile (10) which is stacked on the plate part (21) of the upper plate (20) to thereby cover the upper plate and is integrally coupled with the plate part; and a finishing material (40) which is made of synthetic resin and brought into close contact with the tapered lateral part (21) of the upper plate (20) to provide an aesthetic appearance. The upper plate (20) and the lower plate (30) are coupled by means of spot welding, riveting, tox, etc., and the upper plate (20) and the external tile (10) are fixed to each other by gluing.

Furthermore, according to the raised access floor panel material structure of the present invention, a plurality of through-holes (23) are formed at constant intervals in the tapered lateral part (21) of the upper plate (20), and a plurality of fitting protrusions (41) corresponding to the through-holes (23) are formed on a contact surface of the finishing material (40) attached to the tapered lateral part (21) and are fitted into the through-holes to thereby achieve a firm coupling, and it is preferable that the rim part (24) is formed so as to vertically extend upwards from the tapered lateral part (22) of the upper plate (20) bent downwards, thereby delimiting the plate part (21) of the upper plate (20) and the external tile (10) is accommodated inside the rim part (24), and an end portion of the planar rim part (32) of the lower plate (30) is bent to form a part (36) corresponding to the tapered lateral part (22) of the upper plate (20), which part is bent at the same angle as the tapered lateral part so as to be brought into area-contact therewith and thus a close area-contact of the upper plate (20) and the lower plate (30) can be achieved.

Furthermore, according to the raised access floor panel material structure of the present invention, the finishing material (40) closely contacting with an outer surface of the tapered lateral part (22) of the upper plate (20) is preferably shaped in the form of the molded block (50) by molding, wherein, in molding, an edge part of the upper external tile (10), inner and outer surfaces of the tapered lateral part (22) and the planar rim part (32) of the lower plate (30) are all accommodated and firmly coupled with one another in the molding by forming the through-holes (23) in the tapered lateral part (22), and the punching shaped parts (33) formed in the lower plate (30) may have any shape selected from planar shape, circular shape, polygonal shape, diamond shape and star shape, and the space part (31) formed in the lower plate (30) may be filled with any one selected from inorganic core, organic core, metal-organic core, metal-inorganic core, and a mixture of metal, organic core and inorganic core.

Furthermore, a method for forming the floor panel material according to another characteristic of the present invention includes a first step wherein the upper plate (20) and the lower plate (30) are formed by the punching, and in a state of being stacked and coupled, the upper plate (20), the lower plate (30) and the external tile (10) are rested on an inner side of a lower mold (60) while surrounded by a lateral mold (80), with a bent tapered lateral part (22) of the upper plate (20) being spaced apart from the lateral mold while surrounding a mold core (61) protruding from the inner side of the lower mold (60); a second step wherein the upper mold (70) is stacked over the stacked upper plate (20) to thereby cover the upper plate, and with the upper mold (70) being stacked, the tapered lateral part (22) is supported by a stopper rod (81) which protrudes from the lateral mold (80) into the inside of the mold to support the tapered lateral part behind thereof in order to maintain a bent angle of the tapered lateral part (22); a third step wherein when the mold is perfectly mounted, the mold is mounted so that the molding space part (77)(hollow part) is defined by an edge part of the upper external tile (10), inner and outer surfaces of the tapered lateral part (22) and the rim part of the lower plate, and the injection molding material is injected into the molding space part (77) between the mold core (61) and the lateral mold; and a fourth step wherein the injection-molded block (50) is cured, whereby the molded block (50) is coupled with the raised access floor panel material.

Furthermore, according to the method for forming the floor panel material of the present invention, the tapered lateral part (22) is formed so that it is inclined inwards at a tapered angle of 4 to 5° with respect to a vertical direction, and a curved molded part (K) is also created in a curved space formed by a round portion of corner which is naturally generated when the tapered lateral part (22) of the upper plate (20) is bent, whereby more firm coupling of the molded block (50) to the finishing material and the vertical bent part is achieved when attaching the finishing material.

Effects of the Invention

The present invention has a great advantage in that more firm finishing can be achieved by adding the molded block as the finishing material to the tapered lateral part of the floor panel material.

Furthermore, the present invention has a great advantage in that the tapered lateral part remaining in the form of a frame inside the molded block is prevented from being shifted to one side in a right-and-left direction even during a high-pressure insert molding process and thus more firm floor panel material with a high durability is obtained.

Furthermore, the present invention has a great advantage in that by forming the lower plate in the form of a plate by punching to impart a certain thickness to the lower plate, the lower plate is more rigid and a material for the lower plate is less used, thereby reducing a production cost.

BEST MODES FOR CARRYING OUT THE INVENTION

Figure 1:
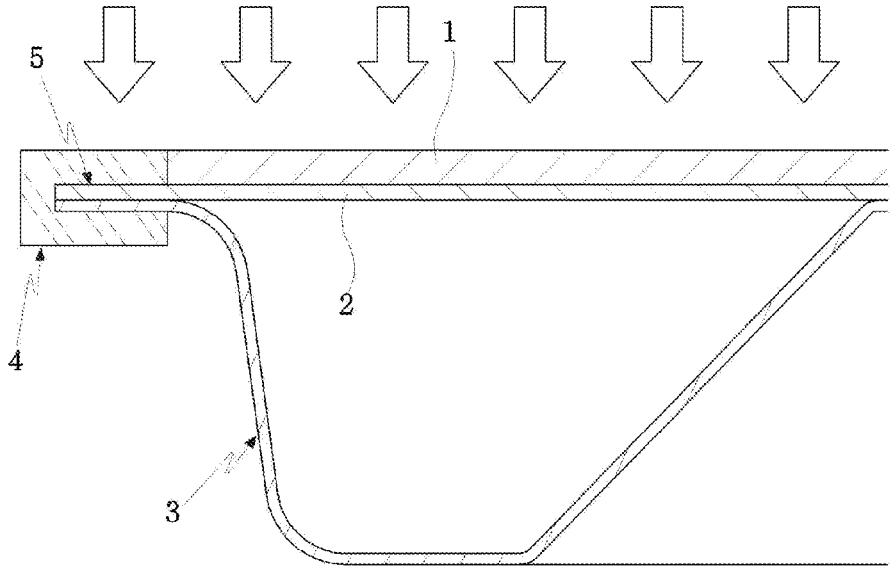
FIG. 1 is a cross-sectional view illustrating a conventional floor panel material generally used.
Figure 2:
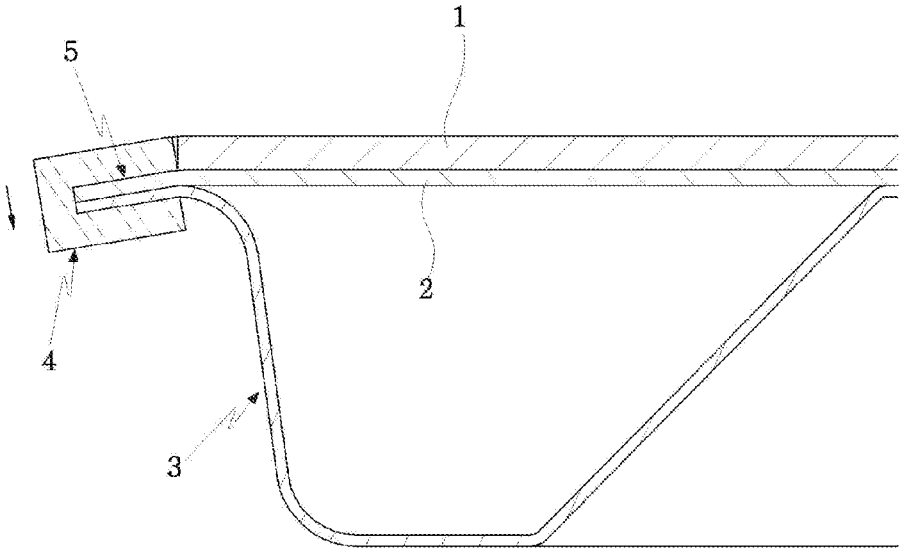
Prior Art FIG. 2
FIG. 2 is a view showing a problem of the conventional floor panel material.

A floor panel material of the present invention includes a lower plate (30) which is formed by punching a plate and pressing the plate to obtain a certain width in an up-and-down direction, in such a way that a central area of the lower plate has a space part (31) and punching shaped parts (33) and an edge area has a planar rim part (32) with a constant level; an upper plate (20) which is stacked on an upper end of the lower plate (30) to thereby cover the lower plate, a central area of which forms a flat plate part (21), and an edge area of which has a tapered lateral part (22) bent downwards so as to accommodate the width of the lower plate (30); an external tile (10) which is stacked on the plate part (21) of the upper plate (20) to thereby cover the upper plate and is integrally coupled with the plate part; and a finishing material (40) which is made of synthetic resin and brought into close contact with the tapered lateral part (21) of the upper plate (20) to provide an aesthetic appearance. The upper plate (20) and the lower plate (30) are coupled by means of spot welding, riveting, tox, etc., and the upper plate (20) and the external tile (10) are fixed to each other by gluing.

Figure 3:
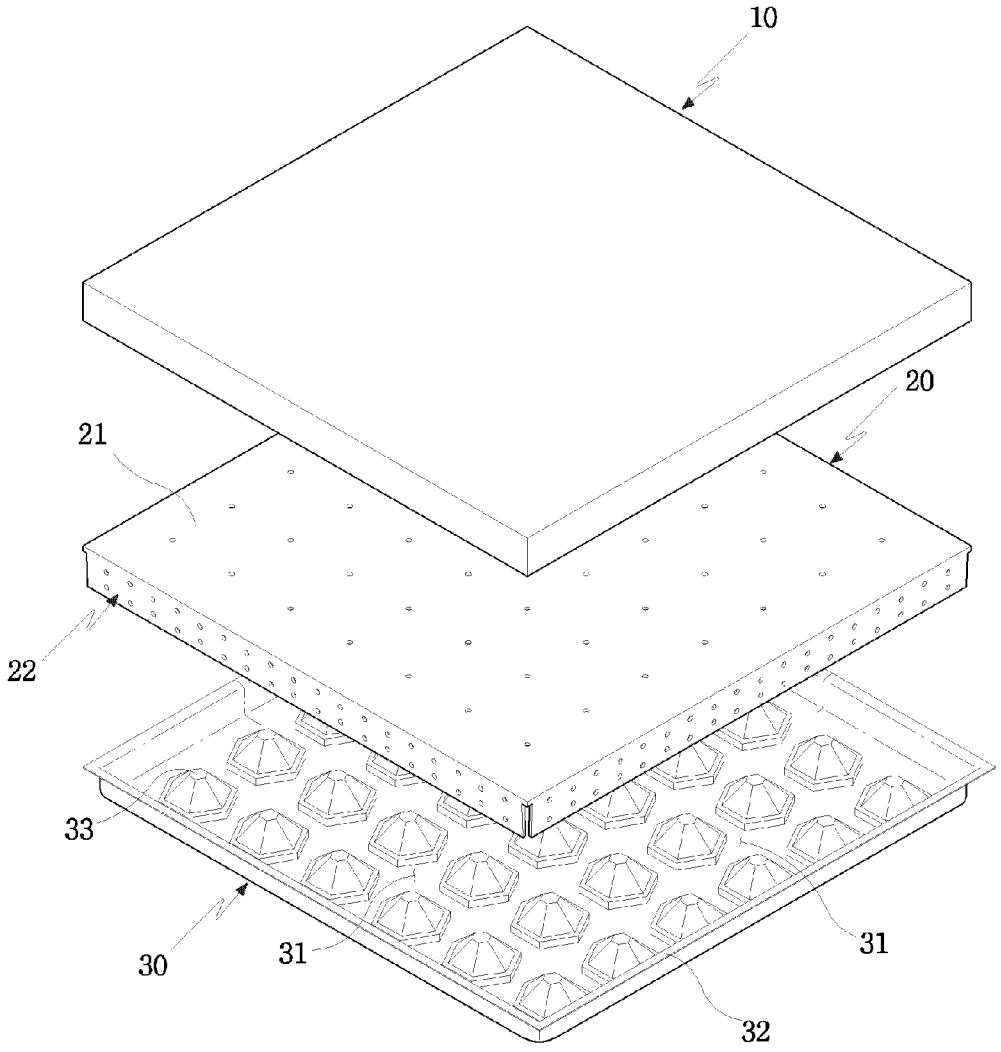
FIG. 3 is an exploded perspective view illustrating a state of stacking and coupling a floor panel material of the present invention.

First, the floor panel material of the present invention includes the upper plate (20), the lower plate (30) and the external tile (10) attached to an upper end of the upper plate (20), as illustrated in FIG. 3. For practical use of the floor panel material, the lower plate (30) is laid on the floor with legs attached to a lower end of the lower plate. The legs are provided with passages through which multiple power lines and communication lines pass, and the external tile (10) attached to the upper end of the upper plate (20) defines a floor of a floor surface. The upper plate (20) and the lower plate (30) are firmly coupled by means of spot welding, riveting, tox, etc., and a way of coupling the upper plate (20) and the external tile (10) is not particularly limited, but the two plates are perfectly coupled mainly by gluing. The lower plate (30) is formed into a certain shape by punching a metal plate, wherein a flat metal plate is interposed between an upper mold and a lower mold and then the upper mold is lowered to perfectly press the flat metal plate, whereby parts of a certain shape are formed protruding from the flat metal plate. At this time the lower plate (30) is completed, and in the pressing process, a certain thickness is imparted to the lower plate (30). The purpose of imparting the certain thickness is to obtain a stability of the floor panel material. On the contrary, the upper plate (20) has a simple form. In other words, the upper plate (20) is also produced in a certain form by bending a metal plate, wherein, as illustrated in the drawings, the central area of the upper plate forms the flat plate part (21) and the edge area is bent downwards to form the lateral part. A key point is that the lateral part is not a vertical lateral part but is the tapered lateral part (22) inclined at a certain angle. The tapered lateral part is formed considering the floor panel materials connected with each other. Furthermore, a main purpose of forming the tapered lateral part (22) in the floor panel material of the present invention is to allow an end of the tapered lateral part (22) to substantially support the floor panel material, thereby safely supporting a weight even when a load is applied to an end of the floor panel material or when a great force is transmitted to the end. In a case of conventional floor panel material, as illustrated in FIG. 1, when an end of the floor panel material is stepped on, the end is deflected or a part on other side is raised and inclined and the floor panel material is very likely to have an unsafe position. Furthermore, noise may occur and the floor panel may become unstable on the whole. Eventually, the present invention has solved such problems.

Multiple floor panel materials are connected with each other for being positioned in a certain space and thus form the floor surface. At this time, the lateral parts of different floor panel materials are connected while being in close contact with each other. If the lateral parts are horizontally oriented, severe noise occurs when friction is generated between the lateral parts. To solve this problem, the applicant of the present invention imparts an angle to the lateral part to form the tapered lateral part (22) so that the lateral parts are not brought into area contact with each other but into linear contact. For this purpose, the tapered lateral part (22) of the upper plate is provided. The upper plate (20) and lower plate (30) thus formed are firmly coupled in close contact with each other by means of spot welding, riveting, tox, etc. In this way, a panel is formed having a certain thickness, i.e. a thickness as large as a pressed depth of the lower plate (30). Also, the external tile (10) is glued to the plate part (21) of the upper plate (20) and thus allows the floor panel material to act as a perfect floor panel material.

However, in the present invention, for more securely ensuring the linear contact between the upper plate (20) and the lower plate (30) each made of metal material, the finishing material (40) is attached to the tapered lateral part (22) lateral to the upper plate (20) and the lower plate (30). The finishing material (40) attached at a tapered angel due to the tapered lateral part (22) is formed of synthetic resin material. The finishing material may be attached by gluing for its use, and fusion or separate fastening means also may be used for attaching the finishing material. The finishing material (40) in the form of band may be attached by taping to complete the floor panel material.

Next, embodiments of the present invention will be described in detail with reference to the attached drawings. A plurality of through-holes (23) are formed at constant intervals in the tapered lateral part (21) of the upper plate (20), and a plurality of fitting protrusions (41) corresponding to the through-holes (23) are formed on a contact surface of the finishing material (40) attached to the tapered lateral part (21) and are fitted into the through-holes to thereby achieve a firm coupling. That is to say, this relates to a different embodiment of coupling the finishing material (40).

Figure 4:
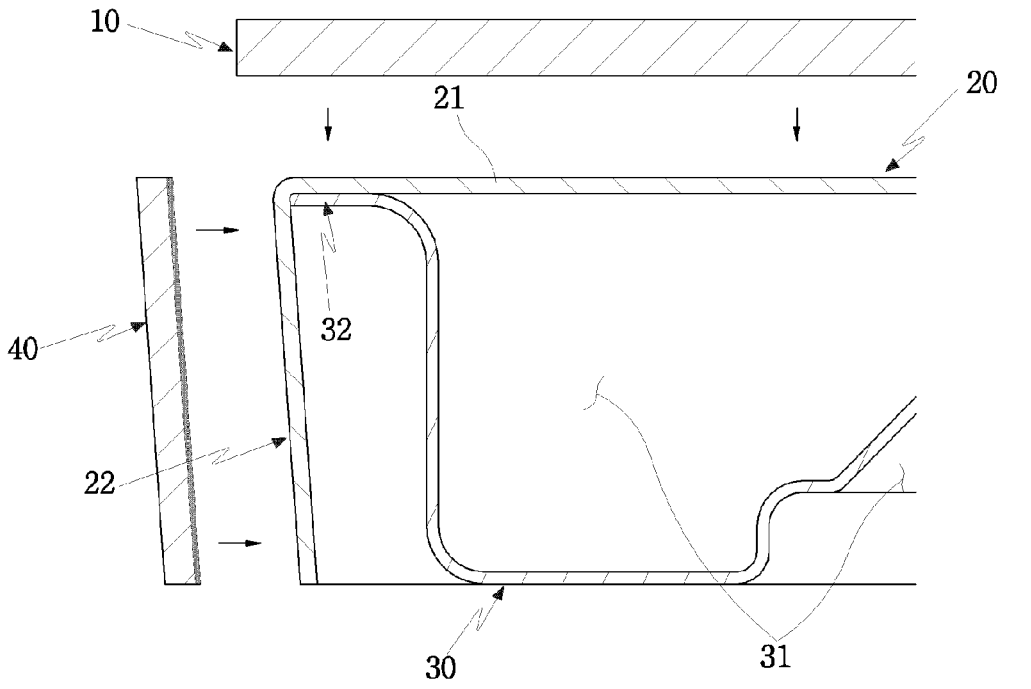
FIGS. 4(*a*) and (*b*) are views illustrating a finishing material coupling method according to an embodiment of the present invention.
Figure 4:
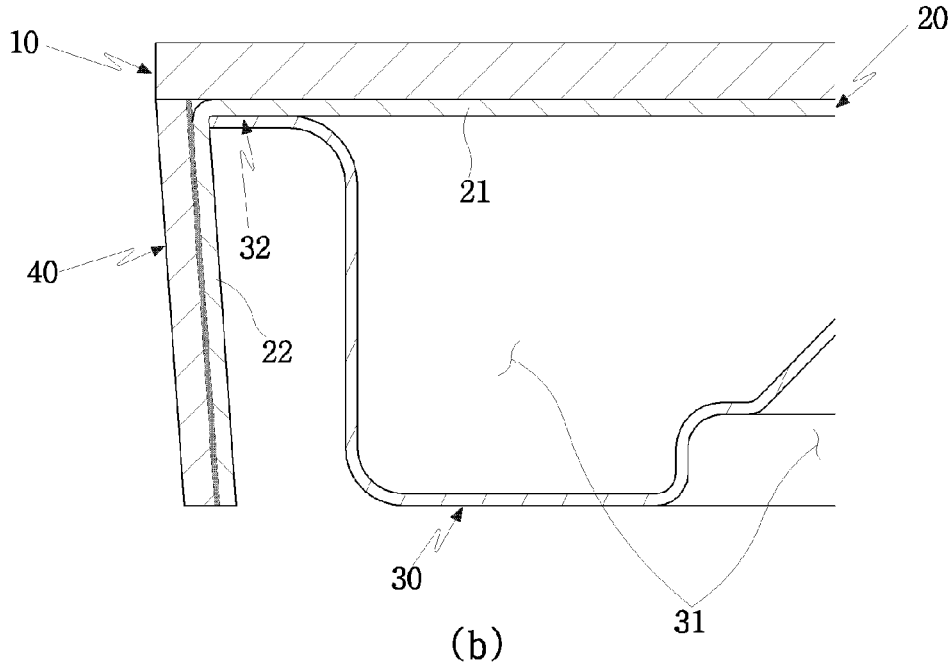
Figure 5:
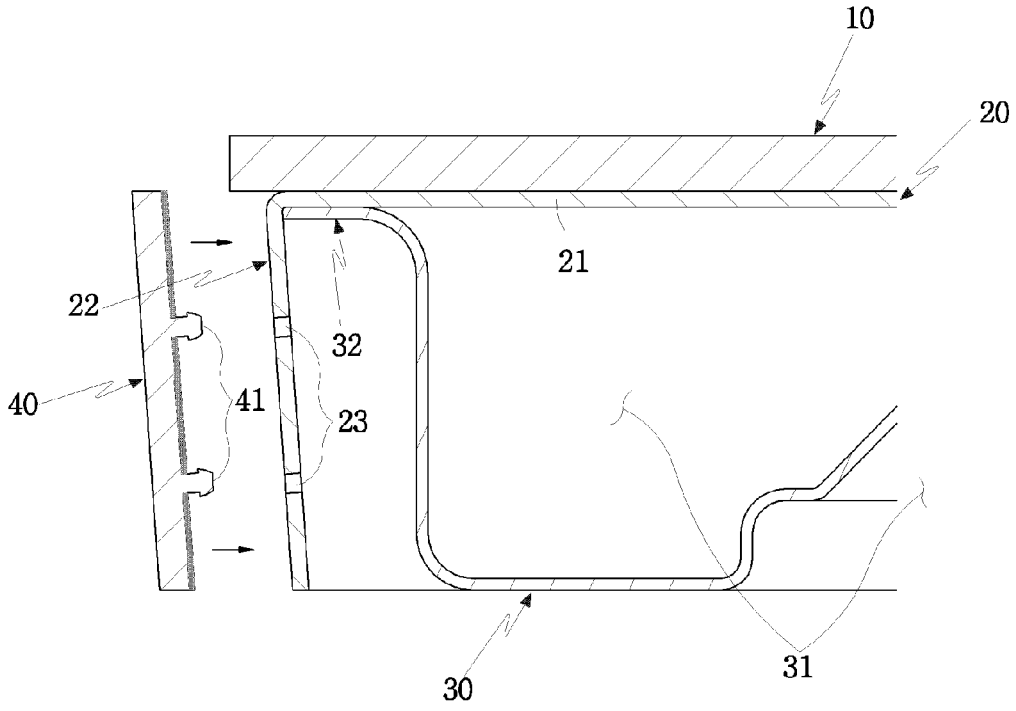
FIG. 5 is a view illustrating a finishing material coupling method according to another embodiment of the present invention.

FIG. 4 illustrates an embodiment wherein the finishing material (40) in the form of band is glued to the tapered lateral part (21) by applying adhesive on the finishing material, and FIG. 5 illustrates a way wherein the fitting protrusions (41) are protrudingly formed on the contact surface of the finishing material (40) and are fitted and coupled into the through-holes (23) formed in the tapered lateral part (22). That is to say, the fitting protrusions (41) are formed on the contact surface of the finishing material (40) while protruding therefrom and the corresponding through-holes (23) are formed in the tapered lateral part (22), and the fitting protrusions (41) are inserted and tightly fitted and coupled into the through-holes (23) when the finishing material (40) and the tapered lateral part (22) contact with each other. Once the fitting protrusions are fitted and coupled into the through-holes, the fitting protrusions cannot be removed from the through-holes, and thus a safe floor panel material can be formed. As described below, the through-holes (23) are also used as an element for perfectly coupling a molded block (50) which is molding-processed, and in the case of this embodiment, it secondarily serves to prevent removal of the fitting protrusions (41).

Figure 6:
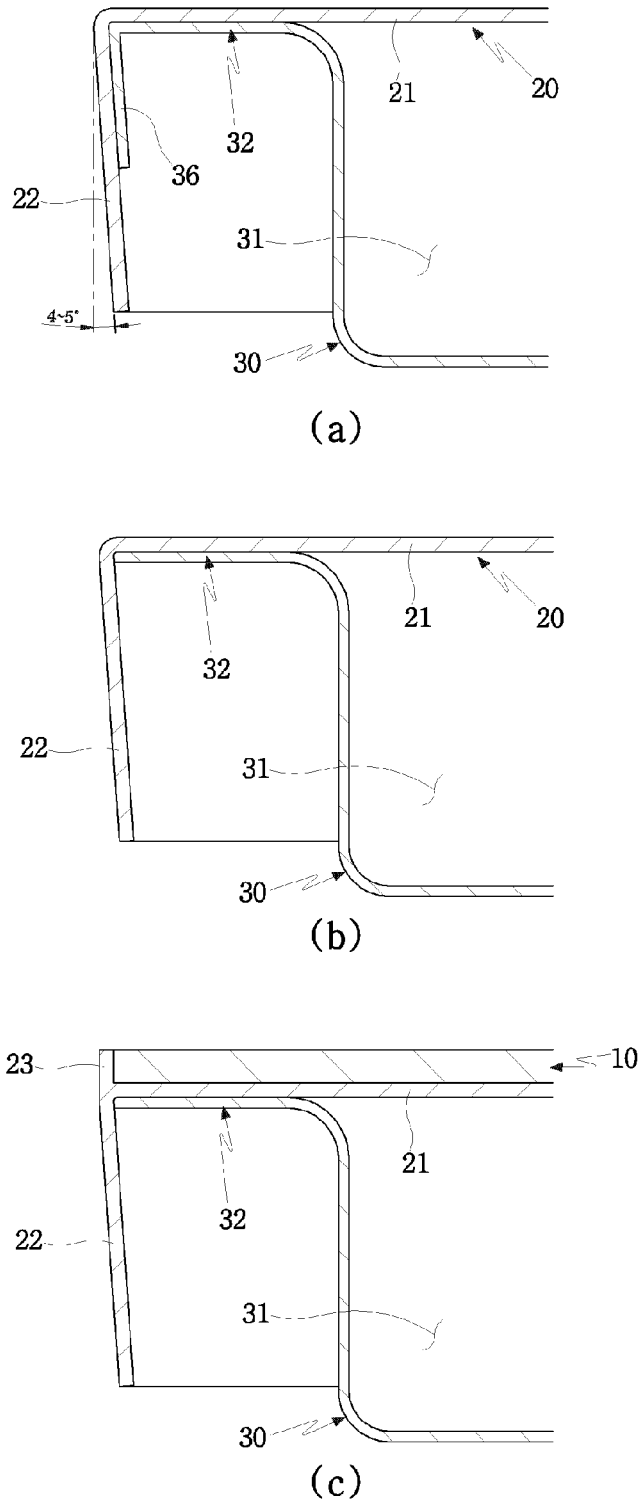
FIGS. 6(*a*), (*b*) and (*c*) are views illustrating a cross-section of the floor pate material according to an embodiment of the present invention.

Next, in the present invention, it is preferable that the rim part (24) is formed so as to vertically extend upwards from the tapered lateral part (22) of the upper plate (20) bent downwards, thereby delimiting the plate part (21) of the upper plate (20) and the external tile (10) is accommodated inside the rim part (24). This embodiment is illustrated in FIG. 6(*c*), wherein for protecting the external tile (10), the rim part (24) is formed by a vertical upper part of the tapered lateral part (22).

The external tile (10) is accommodated inside the rigid rim part (24) made of metal material in close contact with the rim part and thus can be more securely protected. This is an embodiment capable of enhancing the durability of the floor panel material. On the other hand, an embodiment is also preferable wherein an end portion of the planar rim part (32) of the lower plate (30) is bent to form a part (36) corresponding to the tapered lateral part (22) of the upper plate (20), which part is bent at the same angle as the tapered lateral part so as to be brought into area-contact therewith and thus a close area-contact of the upper plate (20) and the lower plate (30) can be achieved. FIG. 6(*c*) described above illustrate an embodiment wherein, in the case of the upper plate (20), the planar rim part (32) formed by an outer portion of the plate part (21) horizontally protrudes. However, in the present invention, by bending the planar rim part (32), a separate part (36) may be formed which corresponds to the tapered lateral part (22) of the upper plate and which can be brought into area-contact with the tapered lateral part along the same, as illustrated in FIG. 6(*a*). The upper plate (20) and the lower plate (30) can be more closely coupled with each other by means of spot welding and thus the durability of the floor panel material can be enhanced.

In the above-described embodiment, a structure has been described where the finishing material (40) of the present invention is produced in the form of a separate band and is coupled by gluing or fitting. However, the most important embodiment of the present invention has a main characteristic that the finishing material (40) is provided by molding and thus firmly coupled. The finishing material (40) of this embodiment is particularly called the molded block (50); a main configuration of the block is as follows. That is to say, the finishing material (40) closely contacting with an outer surface of the tapered lateral part (22) of the upper plate (20) is preferably shaped in the form of the molded block (50) by molding, wherein, in molding, an edge part of the upper external tile (10), inner and outer surfaces of the tapered lateral part (22) and the planar rim part (32) of the lower plate (30) are all accommodated and firmly coupled with one another in the molding by forming the through-holes (23) in the tapered lateral part (22).

Figure 7:
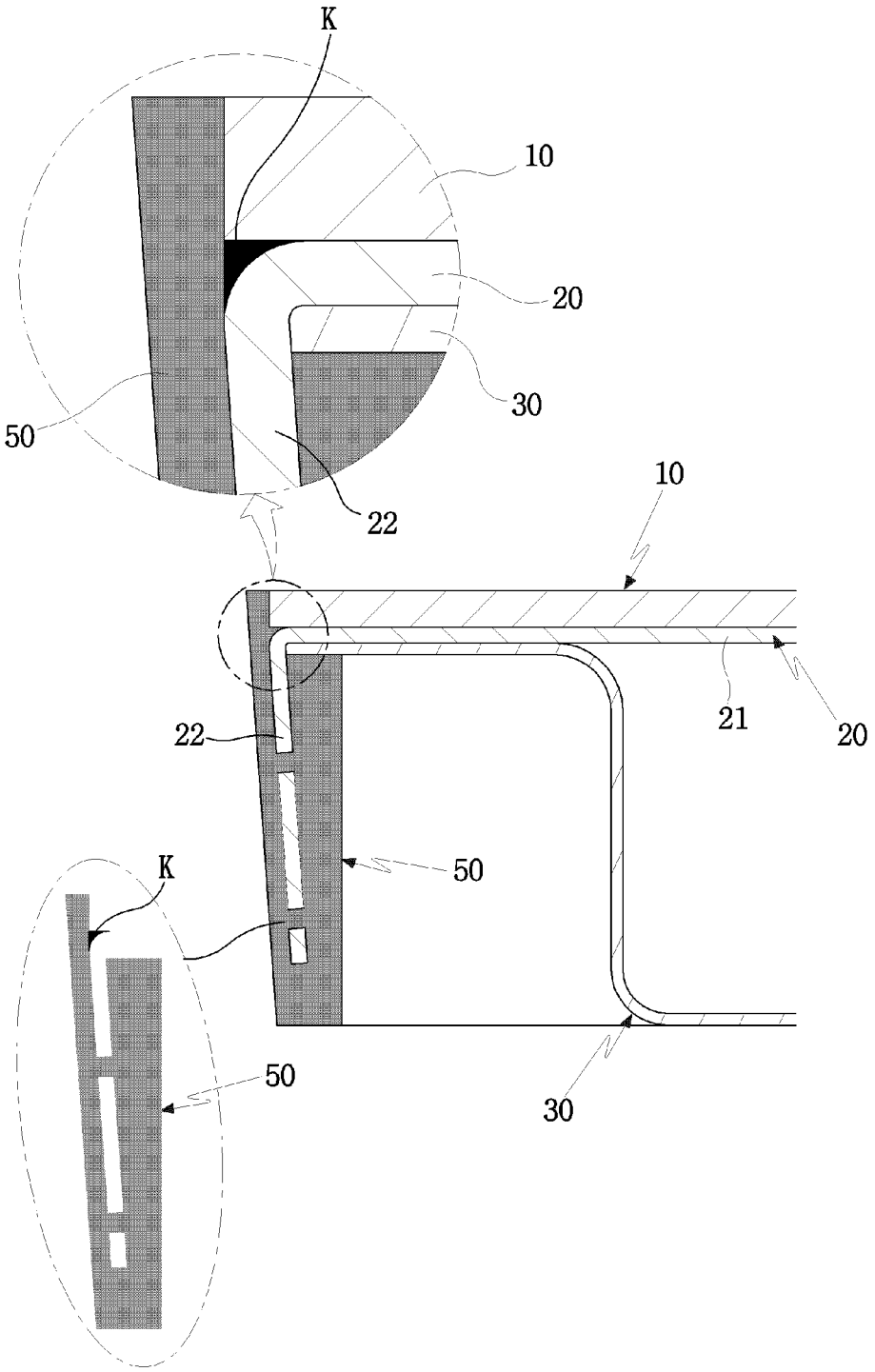
FIG. 7 is a cross-sectional view illustrating an embodiment where a molded block is used as the finishing material of the present invention.

As will be described in detail in connection with a forming method described below, in the present invention, the floor panel material with the upper plate (20), the lower plate (30) and the external tile (10) firmly coupled is put in the mold and then is subject to the molding. That is to say, the molding is performed as illustrated in FIG. 7. By the molding, the upper plate (20) and the lower plate (30) are more closely coupled, and a rim defining an outer part of the external tile (10) can be also formed by the molding. The molding is regarded as being important in the present invention since the molding provides a neat finish and allows the finishing material to be firmly formed.

Meanwhile, as already described above, in the present invention, the lower plate is formed by punching a flat metal plate. The lower plate (30) is divided into the space part (31) and the punching shaped parts (33) by the punching, as illustrated in the drawings; the lower plate is illustrated in detail in FIG. 3. As illustrated in this figure, the punching shaped parts (33) formed in the lower plate (30) may have any shape selected from planar shape, circular shape, polygonal shape, diamond shape and star shape. Those shapes can be simply formed by a shape of the mold for the punching. In the figure, the punching shaped parts (33) of hexagonal shape are illustrated, but are not limited to such a shape. The diamond shape as well as the planar shape and circular shape may be used. Also, the punching shaped parts may have every polygonal shape, i.e. rectangular shape and octagonal shape as well as triangular shape.

Furthermore, as mentioned above, the space part (31) is formed in the lower plate (30) by the punching; the space part (31), i.e. the space part (31) formed in the lower part (30) may be filled with any one selected from inorganic core, organic core, metal-organic core, metal-inorganic core, and a mixture of metal, organic core and inorganic core. In the present invention, the main purpose of forming the space part (31) is to reduce cost for metal material used while reducing the weight of the floor panel material. By forming the space part (31), the lower plate (30) of the present invention has a certain thickness and a rigidity of the lower plate is increased. Furthermore, the lower plate is easy to assemble since it has the certain thickness, i.e. width. In the present invention, with the use of such an effective structural characteristic, more rigid lower plate (30) can be obtained by making the lower plate itself in the form of a frame and filling the space part (31) with separate material.

The space part (31) may be filled with the inorganic core or organic core. Also, a mixture of metal and organic core or a mixture of metal and inorganic core may be used. Of course, the space part may be filled with a mixture of metal, organic core and inorganic core.

Next, a method for forming the floor panel material will be described in detail, which method is another characteristic of the present invention.

In a first step of the method for forming the floor panel material of the present invention, the upper plate (20) and the lower plate (30) are formed by the punching, and in a state of being stacked and coupled, the upper plate (20), the lower plate (30) and the external tile (10) are rested on an inner side of a lower mold (60) while surrounded by a lateral mold (80), with the bent tapered lateral part (22) of the upper plate (20) being spaced apart from the lateral mold while surrounding a mold core (61) protruding from the inner side of the lower mold (60).

The upper plate (20) and the lower plate (30) are pressed and formed by the punching. The upper plate (20) and the lower plate (30) are all pressed using a metal plate and then stacked with each other, and are coupled in one piece by means of spot welding, riveting, tox, etc. At this time, the external tile (10) is fixed to an upper side of the upper plate (20) by gluing or a separate way, whereby the floor panel material is completed. For actually completing the floor panel material, the molded block (50) as described above in connection with the floor panel material has to be formed.

That is to say, a molded part, i.e. the molded block (50) illustrated in FIG. 7 is formed by injecting injection molding material.

Figure 8:
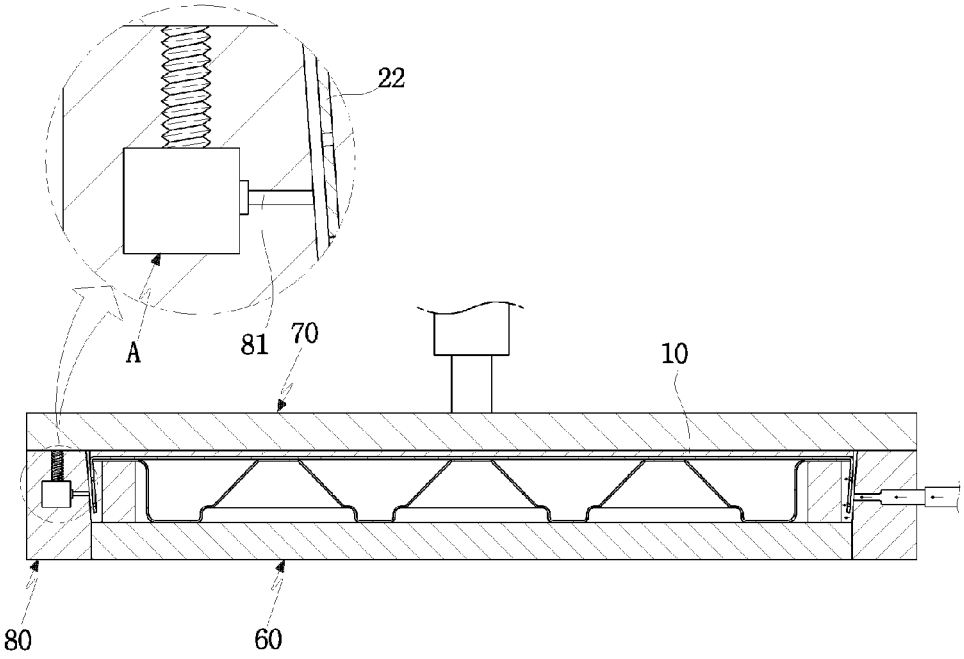
FIG. 8 is a view illustrating a cross-section of the floor panel material of the present invention on the whole.

The present invention substantially relates to a method for forming the molded block (50). The floor panel material with the upper plate (20), the lower plate (30) and the external tile (10) coupled with each other is rested on the mold illustrated in FIG. 8. The mold includes the upper mold (70) and the lower mold (60), and the lateral mold (80) extends beyond a level of an upper end of the lower mold (60). On the inner side of the lower mold (60), the floor panel material with the upper plate (20), the lower plate (30) and the external tile (10) coupled with each other is rested. A matter that requires attention when resting the floor panel material on the lower mold is to rest the floor panel material inside a mold core (61) with a certain height protruding upwards from the lower mold (60). The mold core (61) extends upwards to the upper plate (20) and is positioned inside the tapered lateral part (22). An upper end of the mold core (61) closely contacts with an lower end of the lower plate (30), and thus the injection molding material does not move in a right-and-left direction with respect to the mold core (61). This is important for obtaining the shape of the molded block (50) illustrated in FIG. 7.

Moreover, the lateral mold (80) of the present invention is formed such that its inner surface is tapered at the same angle as the tapered lateral part (22). Therefore, the shape of the molded block (50) illustrated in FIG. 7 is obtained after molding. That is to say, the molded block (50) having the same shape as a molding space part (77) is injection-molded.

Figure 9:
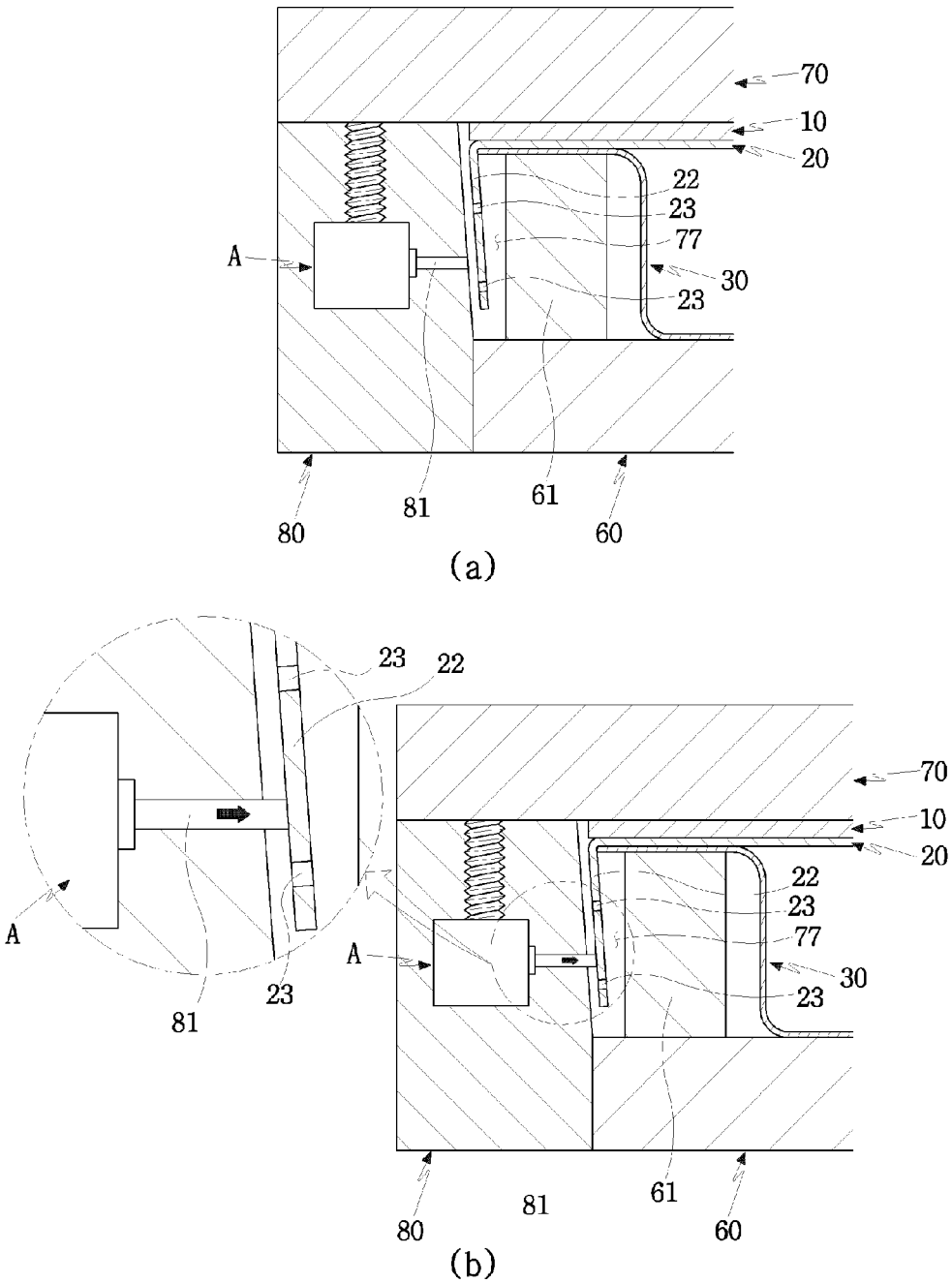
FIGS. 9(*a*) and (*b*) are views illustrating a method for forming the molded block of the present invention.

Next, in a second step of the present invention, the upper mold (70) is stacked over the stacked upper plate (20) to thereby cover the upper plate, and with the upper mold (70) being stacked, the upper mold (70) is put, the tapered lateral part (22) is supported by a stopper rod (81) which protrudes from the lateral mold (80) into the inside of the mold to support the tapered lateral part behind thereof in order to maintain the bent angle of the tapered lateral part (22). After the floor panel material thus coupled has been rested on the upper end of the lower mold (60), the upper mold (70) is put on the floor panel material to close it. In the mold of the present invention, it is a main operation that, during a process of resting the upper mold (70), the stopper rod (81) of an operating device (A) mounted in or outside the lateral mold (80) is operated to support the tapered lateral part (22) of the upper plate. FIG. 9(*a*) illustrates a state before the upper mold (70) is rested on the lateral mold (80) to completely close the mold. On the contrary, FIG. 9(*b*) illustrates a state that the upper mold (70) is rested on the lateral mold (80) while being completely brought into close contact with the mold.

Before the upper mold (70) is rested, the operating device (A) of the present invention does not operate. Therefore, the stopper rod (81) remains retracted inside the operating device (A). On the contrary, after the upper mold (70) has been perfectly rested, the stopper rod (81) extends to support the tapered lateral part (22). This operation is important for the following reason: if the mold core (61) as illustrated in FIG. 9 is not present in the upper mold (70), the lower mold (60) and the lateral mold (80) of the present invention, a formed shape of the molded block (50) may become large when the injection molding material is injected. Therefore, a position, height and shape of the mold core (61) are important for providing a limited space which can maintain a firm coupling while having the least volume.

If the stopper rod (81) is not present in the present invention, there is much possibility that the tapered lateral part (22) deviates from its original bent position and thus takes a position offset in a right-and-left direction when the injection molding material is injected into the molding space part (77) and a pressure of the material becomes larger. This phenomenon hinders the tapered lateral part (22) from acting as a frame in a cross section of the molded block (50). That is to say, the durability decreases and the molding is not accurately implemented. Eventually, in the present invention, the stopper rod (81) approaches the tapered lateral part (22) to prevent the part from being pushed leftwards in the figure illustrated. The is for achieving more accurate molding operation.

Next, in a third step of the present invention, when the mold is perfectly mounted, the mold is mounted so that the molding space part (77)(hollow part) is defined by an edge part of the upper external tile (10), inner and outer surfaces of the tapered lateral part (22) and the rim part of the lower plate, and the injection molding material is injected into the molding space part (77) between the mold core (61) and the lateral mold. That is to say, if a position of the mold is secured, the injection molding material is injected into the inside of the mold to form the molded block (50). The injection molding material is charged only inside the molding space part (77) to form the molded block (50).

Next, in a fourth step of the present invention, the injection-molded block (50) is cured for completing the floor panel material. After the molded block (50) has been formed inside the mold, the block is cured and thus the floor panel material is completed as a product.

Hereinafter, an example of the present invention will be described in more detail.

Figure 10:
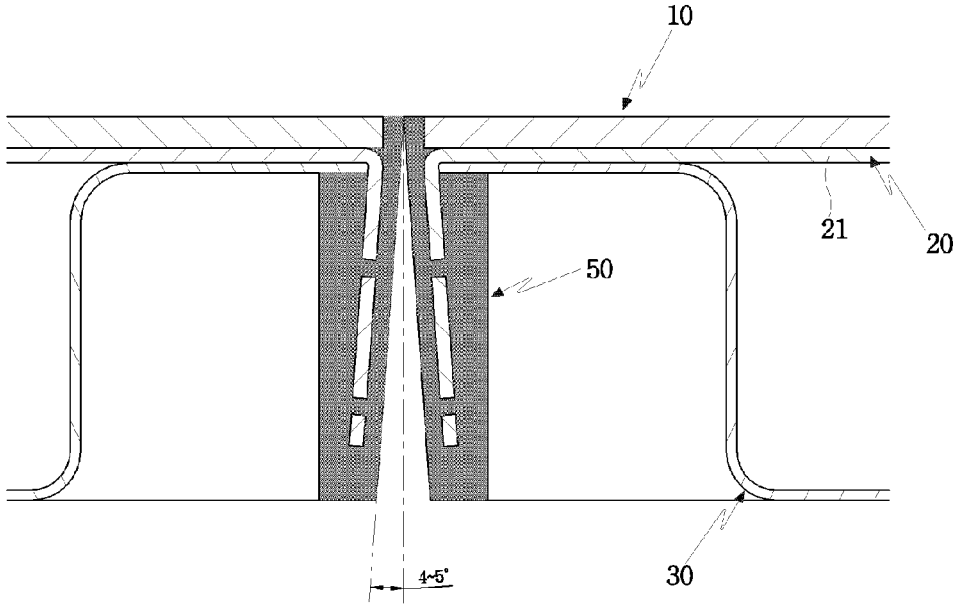
FIG. 10 is a cross-sectional view illustrating a state where the floor panel materials of the present invention are coupled with each other.
Figure 11:
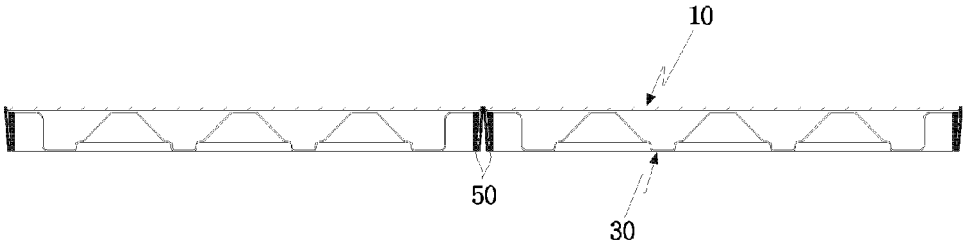
FIGS. 11(*a*) and (*b*) are used state views illustrating a state where the floor panel materials of the present invention are connected with each other.
Figure 11:
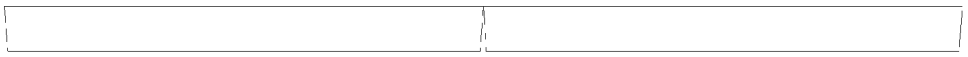

The tapered lateral part (22) is formed so that it is inclined inwards at a tapered angle of 4 to 5° with respect to a vertical direction. The purpose of forming the tapered lateral part (22) has been already described above. In the present invention, as illustrated in FIGS. 10 and 11, a plurality of the floor panel materials are coupled in a linear contact manner where only uppermost ends of the floor panel materials, i.e. uppermost edge parts of the molded blocks (50) are brought into close contact each other. In the case of conventional floor panel materials, an area-contact manner is employed where lateral surfaces contact with each other on the whole, and therefore high noise occurs when the lateral surfaces rub against each other and thus friction is generated. This becomes a problem when the floor panel material is used as a floor surface of the household as well of an office. For solving this problem, in the present invention the tapered lateral part (22) is formed, and thus only the uppermost ends contact with each other and accordingly the least friction is generated. Furthermore, for further increasing such an operation, the molded block (50) wrapping the tapered lateral part (22) is formed from the injection molding material of synthetic resin, thereby achieving more great effect. However, if the angle of the tapered lateral part (22) is too large, there is much possibility that the durability of the floor panel material is decreased. Furthermore, if the angle is too small, actually, the intended effect is difficult to obtain. For solving such problems, in the present invention the angle of the tapered lateral part (22) is set as about 4 to 5°. This range of angle has been determined in view of an angle of 8 to 10° defined by two opposite floor panel materials. Eventually, the angle of 4 to 5° of the tapered lateral part (22) claimed by the present invention is an optimum angle which has been proved through multiple experiments.

Meanwhile, in the present invention, as illustrated in FIG. 7, a curved molded part (K) is also created in a curved space formed by a round portion of corner which is naturally generated when the tapered lateral part (22) of the upper plate (20) is bent, whereby more firm coupling of the molded block (50) is achieved. A conventional way of mounting the finishing material (40) in the form of band or tape does not have measures to bring the finishing material into close contact with the bent round portion of the tapered lateral part (22). In the present invention, the tapered lateral part (22) is naturally formed when the upper plate (20) is produced. Through the punching process a flat plate is pressed and naturally bent; in this stage, a round surface is necessarily formed when the upper plate (22) made of metal is bent. This round surface does not horizontally face a corresponding contacted surface and thus defines a separate space. However, in the case of forming the molded block (50) by injection molding as in the present invention, the injection molding material also penetrates into the blind spot and is molded, whereby the firm coupling of the molded block can be achieved. That is to say, in the shown figure, the curved molded part (K) is precisely it.

DESCRIPTION OF REFERENCE NUMERALS

10: external tile
20: upper plate
21: plate part
22: tapered lateral part
23: through-hole
24: rim part
30: lower plate
31: space part
32: planar rim part
33: punching shaped part
40: finishing material
50: molding block
60: lower mold
70: upper mold
80: lateral mold

What is claimed is:

1. A method for forming a raised access floor panel material, comprising:

a first step wherein an upper plate (20) and a lower plate (30) are formed by punching, and in a state of being stacked and coupled, the upper plate (20), the lower plate (30) and an external tile (10) are rested on an inner side of a lower mold (60) while surrounded by a lateral mold (80), with a bent tapered lateral part (22) of the upper plate (20) being spaced apart from the lateral mold while surrounding a mold core (61) protruding from the inner side of the lower mold (60);

a second step wherein an upper mold (70) is stacked over the stacked upper plate (20) to thereby cover the upper plate, and with the upper mold (70) being stacked, the tapered lateral part (22) is supported by a stopper rod (81) which protrudes from the lateral mold (80) into the inside of the mold to support the tapered lateral part behind thereof in order to maintain a bent angle of the tapered lateral part (22);

a third step wherein when the mold is perfectly mounted, the mold is mounted so that a molding space part (77)(hollow part) is defined by an edge part of the upper external tile (10), inner and outer surfaces of the tapered lateral part (22) and a rim part of the lower plate, and an injection molding material is injected into the molding space part (77) between the mold core (61) and the lateral mold; and a fourth step wherein an injection-molded block (50) is cured, and thereby, the molded block (50) is coupled with the raised access floor panel material.

2. The method for forming a raised access floor panel material according to claim 1, wherein the tapered lateral part (22) is formed so that it is inclined inwards at a tapered angle of 4 to 5° with respect to a vertical direction.

3. The method for forming a raised access floor panel material according to claim 1, wherein a curved molded part (K) is also created in a curved space formed by a round portion of corner which is naturally generated when the tapered lateral part (22) of the upper plate (20) is bent, and thereby, more firm coupling of the molded block (50) is achieved.

* * * * *